United States Patent [19]

van der Meulen

[11] 4,288,963

[45] Sep. 15, 1981

[54] TRIANGULAR COLUMN ARRANGEMENT AND METHOD

[76] Inventor: Gysbert J. R. van der Meulen, 14 Floor, The Strand Tower, 66 Strand St., Cape Town, Cape Province, South Africa

[21] Appl. No.: 24,423

[22] Filed: Mar. 27, 1979

[30] Foreign Application Priority Data

Mar. 30, 1978 [ZA] South Africa ..... 78/1818

[51] Int. Cl.[3] ..... E04G 21/14

[52] U.S. Cl. ..... 52/745; 220/1 B; 264/32; 52/263

[58] Field of Search ..... 52/65, 126, 263, 745; 92/259, 260; 220/1 B; 264/32

[56] References Cited

U.S. PATENT DOCUMENTS

| | | | |
|---|---|---|---|
| 1,445,091 | 2/1923 | Kueffer | 220/220 |
| 2,848,799 | 8/1958 | Hanna | 52/126 |
| 2,959,256 | 11/1960 | Deam | 52/263 |
| 3,057,054 | 10/1962 | Barnes | 29/429 |
| 3,130,488 | 4/1964 | Lindstrom | 29/428 |
| 3,179,374 | 4/1965 | Walli | 52/126 |
| 3,372,518 | 3/1968 | Rensch | 52/227 |
| 3,374,593 | 3/1968 | Rensch | 52/283 |
| 3,500,601 | 3/1970 | Hamill | 52/236 |
| 3,733,762 | 5/1973 | Pardo | 52/263 |
| 3,906,700 | 9/1975 | Fujiwara et al. | 52/747 |
| 4,023,318 | 5/1977 | Ellen | 52/259 |

FOREIGN PATENT DOCUMENTS

| | | | |
|---|---|---|---|
| 6950 | 5/1922 | Netherlands | 52/263 |
| 404168 | 12/1966 | Switzerland | 52/65 |

*Primary Examiner*—James L. Ridgill, Jr.
*Attorney, Agent, or Firm*—Stevens, Davis, Miller & Mosher

[57] ABSTRACT

A method of construction in which a plurality of vertical columns are cast on a base, the columns being arranged at the vertices of contiguous, congruent, equilateral triangles. A roof slab is then cast on the base, the roof slab having apertures through which the columns pass. Reinforcing mats give rise to a plurality of reinforced zones arranged in a pattern which reproduces the pattern of apertures are cast into the slab. The pattern of zones is displaced 60° with respect to the pattern of apertures. Subsequently the slab is raised, preferably by flotation, until it is clear of the columns, and then turned through 60° so that the reinforced zones lie above the columns. Thereafter, the roof slab is lowered onto the columns.

2 Claims, 7 Drawing Figures

TRIANGULAR COLUMN ARRANGEMENT AND METHOD

This invention relates generally to a method of erecting a roof slab, and to the structures resulting from application of the method.

BACKGROUND TO THE INVENTION

It is known to erect a roof on a civil engineering work such as a reservoir by fabricating the roof on the base of the reservoir, and then floating it upwardly into position by filling the reservoir.

GENERAL DESCRIPTION OF THE INVENTION

The object of the present invention is to provide a structure and a method which are improvements over known structures and methods.

The structure according to the present invention comprises a plurality of structural support columns located at the vertices of contiguous, congruent, equilateral triangles, and a roof slab having apertures arranged in a pattern reproducing the pattern of columns, the apertures being of a size such that the columns can pass therethrough, and the roof slab further having a plurality of reinforced zones the centres of which are at the vertices of contiguous, congruent, equilateral triangles, the plurality of reinforced zones being arranged in a pattern reproducing the pattern of apertures but displaced circumferentially with respect thereto, and each being above one of the columns.

This structure is of simple design and has a substantial advantage in that it is repetitive insofar as the reinforcing mats at the reinforced zones in the roof slab are concerned.

Apart from those mats which are adjacent the periphery of the roof slab, the reinforcing mats can be identical throughout the area of the roof slab. This obviously leads to economies both in design and during actual construction.

The inventions also extends to a method of erecting a roof slab, comprising casting a plurality of structural support columns at the vertices of contiguous, congruent, equilateral triangles, the columns extending upwardly from a base, and casting a roof slab on said base, the columns passing upwardly through apertures in the slab, the roof slab being cast with a plurality of reinforced zones the centres of which are at the vertices of contiguous, congruent triangles, the plurality of reinforced zones being arranged in a pattern reproducing the pattern of apertures but displaced circumferentially with respect thereto, lifting the roof slab with respect to the base until it is clear of the columns, rotating the roof slab until each reinforced zone is above one of the columns, and lowering the roof slab onto the columns.

The angle of circumferential displacement is preferably 60°.

DESCRIPTION OF PREFERRED EMBODIMENT

The invention will now be described, by way of example, with reference to the accompanying drawings, in which.

Figure 1:
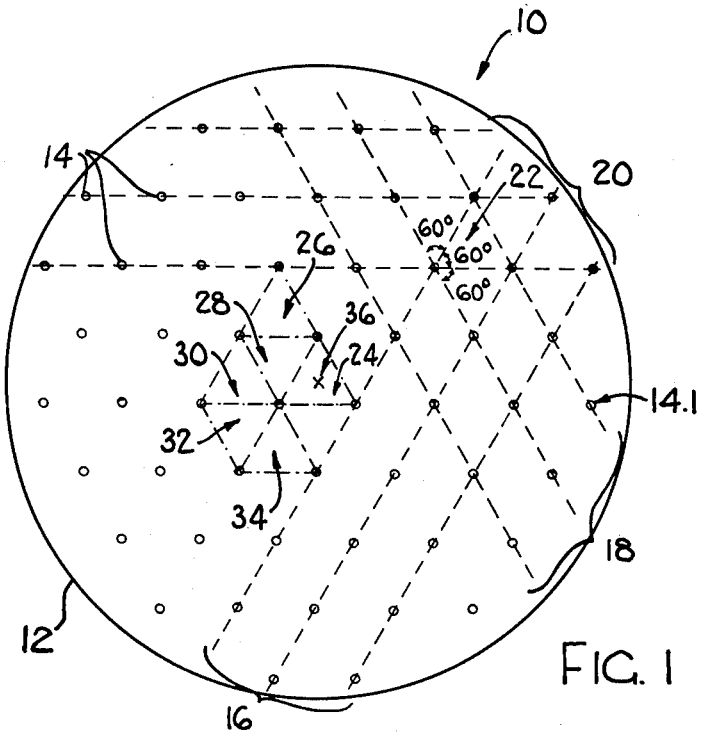
FIG. 1 shows schematically an arrangement of structural support columns.

Referring to FIG. 1, this is a plan view of a reservoir 10 having a circular retaining wall 12 in which is located an arrangement of columns 14. The columns 14 are arranged in three sets of rows 16, 18 and 20. The rows of each set are parallel to one another, and the three sets 16, 18 and 20 intersect one another at 60° as indicated at 22. The columns 14 are spaced apart the same distance in each row and are located at the vertices of contiguous, congruent, equilateral triangles, as indicated by the triangles 24 to 34. The triangle 24 is located such that its centre and the centre of the retaining wall 12 are co-incident, as indicated at 36.

Figure 2:
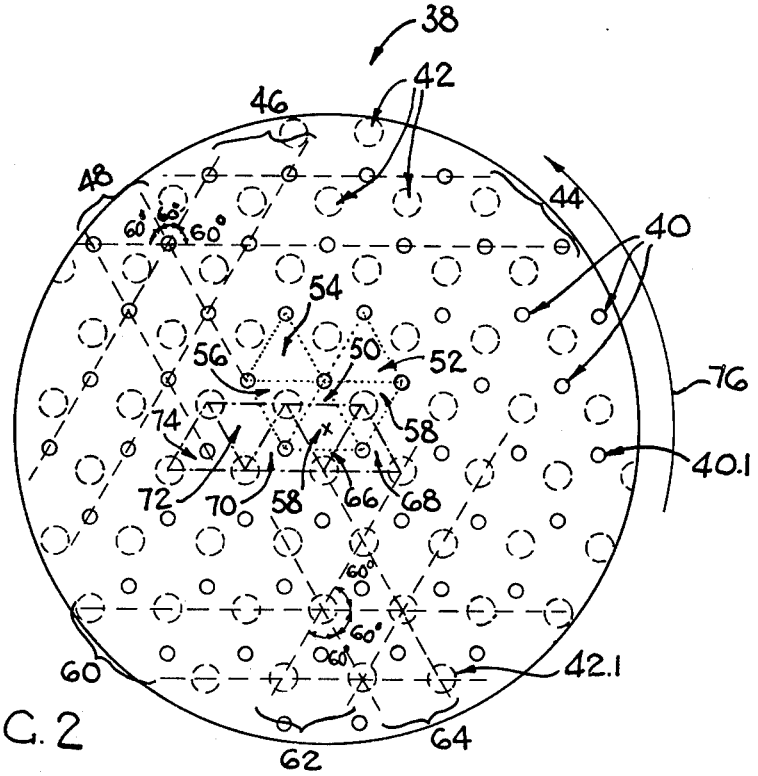
FIG. 2 shows schematically a roof slab having a corresponding arrangement of reinforced zones and apertures.

Referring now to FIG. 2, a roof slab 38 for the reservoir 10 of FIG. 1 is shown. The roof slab 38 is circular and has a number of apertures 40 and reinforced zones 42. The apertures 40 are arranged in three sets of rows 44, 46 and 48 in a similar manner to the columns 14, so that the apertures 14 are also located at the vertices of contiguous, congruent, equilateral triangles, such as triangles 50 to 56. The centre of triangle 50 and the centre of the roof slab 38 are co-incident, as shown at 58. In a similar manner, the reinforced zones 42 are arranged in three sets of rows 60, 62 and 64 with the reinforced zones also being located at the vertices of contiguous, congruent, equilateral triangles such as triangles 66 to 74. The centre of triangle 66 is co-incident with the centre of triangle 50 and the roof slab 38, and is rotated through 180° with respect to the triangle 50. It will be noted that each aperture 40 is at the centre of some reinforced zone triangle, and vice versa, except of course for the peripheral apertures and reinforced zones.

Figure 5:
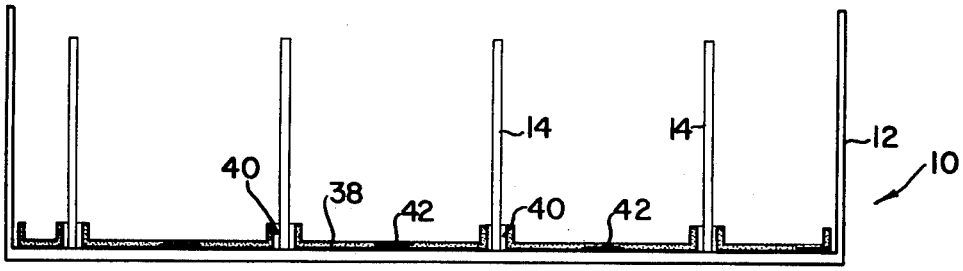
FIG. 5 is a vertical section through a reservoir with a roof slab thereof in a lowered position.
Figure 6:
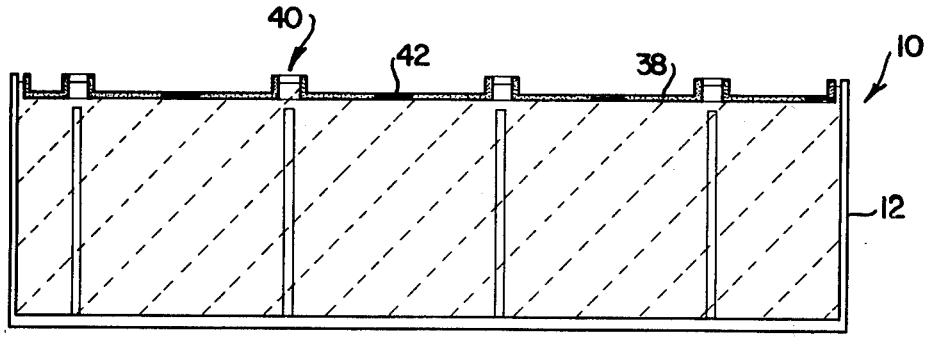
FIG. 6 is a vertical section showing the roof slab raised but not turned.
Figure 7:
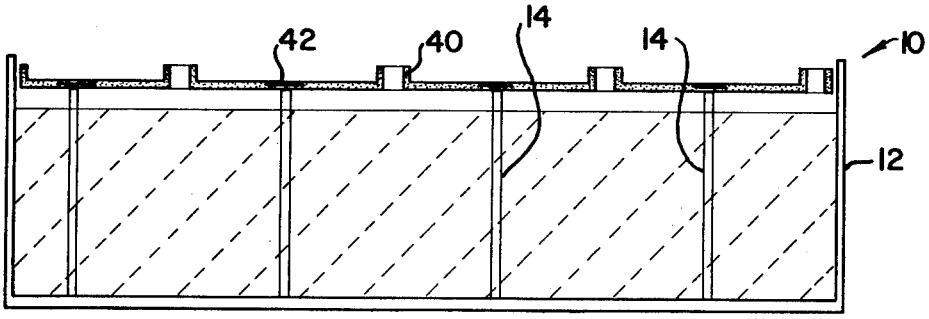
FIG. 7 is a further vertical section showing the roof slab after turning.

In use, the retaining wall 12 and the columns 14 are erected. The roof slab 38 is then cast in situ on the base of the reservoir, with the columns 14 passing through the apertures 40. This condition is shown in FIG. 5. The roof slab 38 is then raised, by flotation or any other suitable manner, until the roof slab 38 is clear of the columns 14. In FIG. 6 the roof slab 38 has been shown floated into a position in which it is above the columns 14. The flotation means, which could be drums or the like, have not been shown. The roof slab 38 is then rotated through 60° about its centre 58 as indicated by arrow 76 in FIG. 2. Rotation can be manual as the floating slab offers little resistance to turning. It will thus be appreciated that the reinforced zones 42 will now be in register with the columns 14. For example, whereas column 14.1 passed through aperture 40.1, reinforced zone 42.1 will be in register with column 14.1 after rotation of the roof slab 38. The roof slab 38 is then lowered to be supported on the columns 14. This is shown in FIG. 7.

While it is preferred that the roof slab be rotated through 60°, rotation through multiples of 60° such as 120° and 180° is possible.

It will be appreciated by those skilled in the art that with such an arrangement of columns, the amount of reinforcing in the roof slab is optimally reduced. Further, with a manner of erecting a roof slab as described above, in which the roof slab is raised, rotated and lowered, it becomes progressively more difficult, as the number of columns increases, to find suitable column arrangements in which the geometric relationship between columns, apertures and support regions also matches a sensible structural layout which must be considered from the strength and ease of reinforcing, points of view. With the column arrangement of the invention, the apertures and reinforced zones of the roof slab are both at optimum positions so that the reinforcement detailing is greatly simplified and both the strength and amount of reinforcement optimised.

Figure 3:
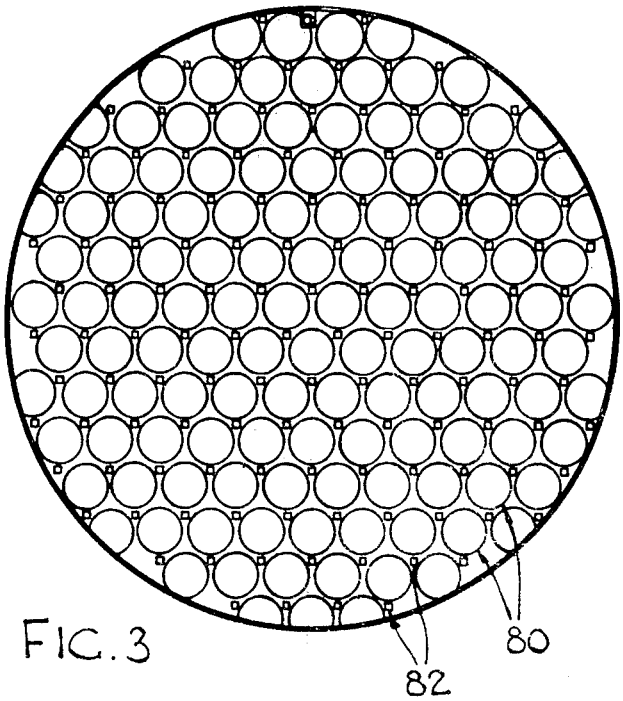
FIG. 3 shows a further roof slab.

Referring now to FIG. 3, this shows a roof slab having a series of reinforced regions 80 and a series of apertures 82. As with the previous embodiment, the regions 80 are arranged in three sets of rows which intersect at 60°. The centres of the regions 80 are at the vertices of contiguous, congruent, equilateral triangles.

The apertures 82 are, of course, coincident with the columns which eventually support the roof.

Figure 4:
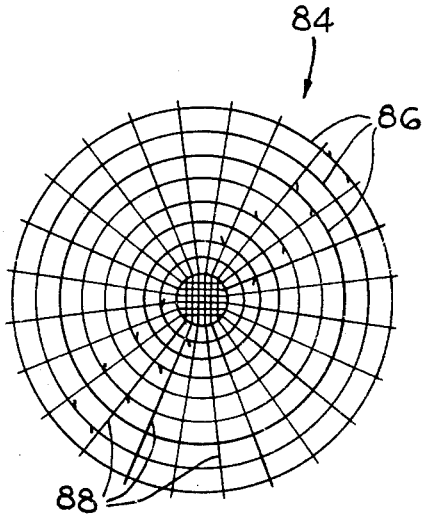
FIG. 4 shows a reinforcing mat.

FIG. 4 illustrates the wire mesh which is used as re-inforcing at each of the circular regions 80. Each wire mesh 84 comprises a series of concentric rings 86 and radial bars 88. The bars cross in the circular region within the inner ring 86 to provide a zone of high density reinforcement. Eventually this zone will be above one of the columns which supports the roof.

Once the columns and the roof slab have been cast, the roof slab is lifted. Vertical motion of the roof slab is guided by virtue of its sliding engagement with the columns. Once the slab is clear of the columns, it is rotated 60° clockwise and then lowered onto the columns.

While mechanical lifting of the roof slab is possible, flotation of the slab into its raised position is the most practical method. The requisite turning motion can then also be obtained in the simplest manner.

I claim:

1. A method of erecting a roof slab, comprising casting a plurality of structural support columns at the vertices of contiguous, congruent, equilateral triangles, the columns extending upwardly from a base, and casting a roof slab on said base, the columns passing upwardly through apertures in the slab, the roof slab being cast with a plurality of reinforced zones the centres of which are at the vertices of contiguous, congruent, triangles, the plurality of reinforced zones being arranged in a pattern reproducing the pattern of apertures but displaced circumferentially with respect thereto, lifting the roof slab with respect to the base until it is clear of the columns, rotating the roof slab until each reinforced zone is above one of the columns, and lowering the roof slab onto the columns.

2. A method as claimed in claim 1, wherein said roof slab is rotated through 60° or a multiple of 60°.

* * * * *

UNITED STATES PATENT AND TRADEMARK OFFICE

CERTIFICATE OF CORRECTION

PATENT NO. : 4,288,963

DATED : September 15, 1981

INVENTOR(S) : Gysbert J. R. Van Der Meulen

It is certified that error appears in the above—identified patent and that said Letters Patent is hereby corrected as shown below:

Item [30] Foreign Application Priority Data should read:

-- March 30, 1978 [ZA] South Africa ..... 78/1817 --.

Signed and Sealed this

*First* Day of *December 1981*

[SEAL]

*Attest:*

GERALD J. MOSSINGHOFF

*Attesting Officer*

*Commissioner of Patents and Trademarks*